US006000878A

United States Patent [19]

Takada et al.

[11] Patent Number: 6,000,878

[45] Date of Patent: Dec. 14, 1999

[54] COVER FOR UNDERGROUND STRUCTURES

[75] Inventors: Hiroyoshi Takada; Junji Wada, both of Fukuoka; Kyozo Sahara, Nagasaki-ken, all of Japan

[73] Assignee: Hinode, Ltd., Fukuoka, Japan

[21] Appl. No.: 08/895,841

[22] Filed: Jul. 17, 1997

[30] Foreign Application Priority Data

Jul. 29, 1996 [JP] Japan ..... 8-199313
Mar. 4, 1997 [JP] Japan ..... 9-049409

[51] Int. Cl.[6] ..... E02D 29/14

[52] U.S. Cl. ..... 404/25; 404/26

[58] Field of Search ..... 404/25, 26; 52/19, 52/20, 177, 179

[56] References Cited

U.S. PATENT DOCUMENTS

| | | | |
|---|---|---|---|
| 314,781 | 3/1885 | Beckwith | 404/25 |
| 2,073,814 | 3/1937 | Small | 404/25 X |
| 4,203,686 | 5/1980 | Bowman . | |
| 4,969,770 | 11/1990 | Bowman . | |
| 5,312,202 | 5/1994 | Newton . | |
| 5,366,317 | 11/1994 | Solimar . | |

FOREIGN PATENT DOCUMENTS

| | | | |
|---|---|---|---|
| 2252013 | 6/1975 | France | 404/25 |
| 58-42252 | 3/1983 | Japan . | |
| 60-27160 | 2/1985 | Japan . | |
| 63-86156 | 6/1988 | Japan . | |
| 7-39964 | 9/1995 | Japan . | |

*Primary Examiner*—Tamara L. Graysay
*Assistant Examiner*—Sunil Singh
*Attorney, Agent, or Firm*—Jordan and Hamburg LLP

[57] ABSTRACT

A cover for underground structures has a large number of mutually independent projections of the same size and shape uniformly provided on its surface, while small protrusions of the same size and shape are formed on the upper surfaces of some or all of these projections. On top of these small protrusions are formed even smaller protrusions of the same size and shape as the topmost protrusions. Spacing between one large projection and another, between one small protrusion and another, or between one small protrusion and a projection having no small protrusion on its top is set at the optimum distance, and the size of the topmost protrusions is also designed in a shape to fit an optimum size to ensure good skid-prevention effect on tires of vehicles passing over the cover, especially in bad weather over a long period of time, no matter where the cover is installed.

13 Claims, 12 Drawing Sheets

COVER FOR UNDERGROUND STRUCTURES

BACKGROUND OF THE INVENTION

The present invention relates to covers for underground structures, and more particularly to covers for underground structures which are designed to more efficiently prevent tires of vehicles such as motorcycles from slipping and skidding.

Covers for underground structures refers herein to large iron covers to close openings which connect buried materials as well as structural sewerage facilities to above ground, manhole covers, covers of house inlets, openable and closable iron covers for common-use tunnels which protect apparatus and equipment for underground power and communications facilities, iron covers for electric power transmission, iron covers for power distribution, fire hydrant covers functioning as openable and closable doors to connect underground conduits in waterworks systems, gas pipes and their accessories to above the ground, sluice valve covers, air-valve covers, covers for gas distributing pipes, and water-gauge valves.

On the surfaces of the currently available bodies of covers for underground structures placed on sidewalks and roadways are formed protruding and recessed patterns which serve as decorations as well to prevent pedestrians from slipping and vehicles from skidding in inclement weather.

Examples of the cover bodies with improved surface patterns for slip and skid prevention are available in Japanese Unexamined Utility Model Publication No. 42252/83 and Japanese Unexamined Utility Model Publication No. 86156/88.

The models disclosed therein are concerned with a cover body on the surface of which is formed projections on top of which are formed small protrusions and recesses, or small protrusions being formed on recessed portions in areas other than the projections. In other words, these models seek to expand the surface coarseness of consecutive protrusions or depressions by adding small protrusions and recesses to the protruding and recessed patterns on top of the cover body and to improve anti-slip and anti-skid performance by increasing frictional resistance.

Nonetheless, the small protrusions and recesses provided on top of the projections on the surface of the cover body come into contact with tires whenever vehicles pass and rub therewith, thereby wearing out with the passage of time after installation, with a resultant reduction of frictional resistance leading to diminished anti-slip and anti-skid effect.

Even immediately after the installation, as dirt, rainwater, and other materials accumulate on the recessed portions of small projections and recesses, the frictional resistance will not effectively act upon the tires, and anti-slip and anti-skid effect will likewise deteriorate.

In this manner, the conventional structure purports to enlarge the surface coarseness of the cover body and to increase frictional resistance, whereas the more provision of small protrusions and recesses fails to maintain the anti-slip and anti-skid performance over a long period of time. Another problem is that when dirt, rainwater, and other materials are involved, it is impossible to bring the anti-slip and anti-skid performance into play at the outset.

These problems are to be resolved by the cover for underground structures according to this invention which can maintain excellent anti-slip and anti-skid performance over a long period of time regardless of the installation environment, through optimization of arrangement patterns of projections provided on the surface of the cover body as well as the shape of the projections.

SUMMARY OF THE INVENTION

Accordingly, an object specified by the present invention is to provide a cover for underground structures wherein small protrusions are formed on top of some or all of the above-mentioned projections, and wherein size of the topmost surface of each topmost level of the above-mentioned small protrusions and projections on which no small protrusion is formed fits inside a circle of a diameter of 25 mm, whereas at least one of the minimum pitches between the outlines of each of the above-mentioned projections and the outlines of the above-mentioned small protrusions is 10 mm to 30 mm long.

BRIEF DESCRIPTION OF THE DRAWINGS

Preferred embodiments of the invention are described in the following detailed description including the drawings in which:

FIG. 2(*b*) is a longitudinal section of FIG. 2(*a*);

FIG. 7(*b*) illustrates a sectional shape of the protruding parts of FIG. 7(*a*) taken in the direction of the arrows substantially along line 7(*b*)—7(*b*);

FIG. 8(*b*) illustrates a sectional shape of the protruding parts of FIG. 8(*a*) taken in the direction of the arrows substantially along line 8(*b*)—8(*b*);

FIG. 10(*b*) shows a sectional shape of the protruding parts of FIG. 10(*a*) taken in the direction of the arrows substantially along line 10(*b*)—10(*b*);

DETAILED DESCRIPTION OF THE INVENTION

Figure 1:
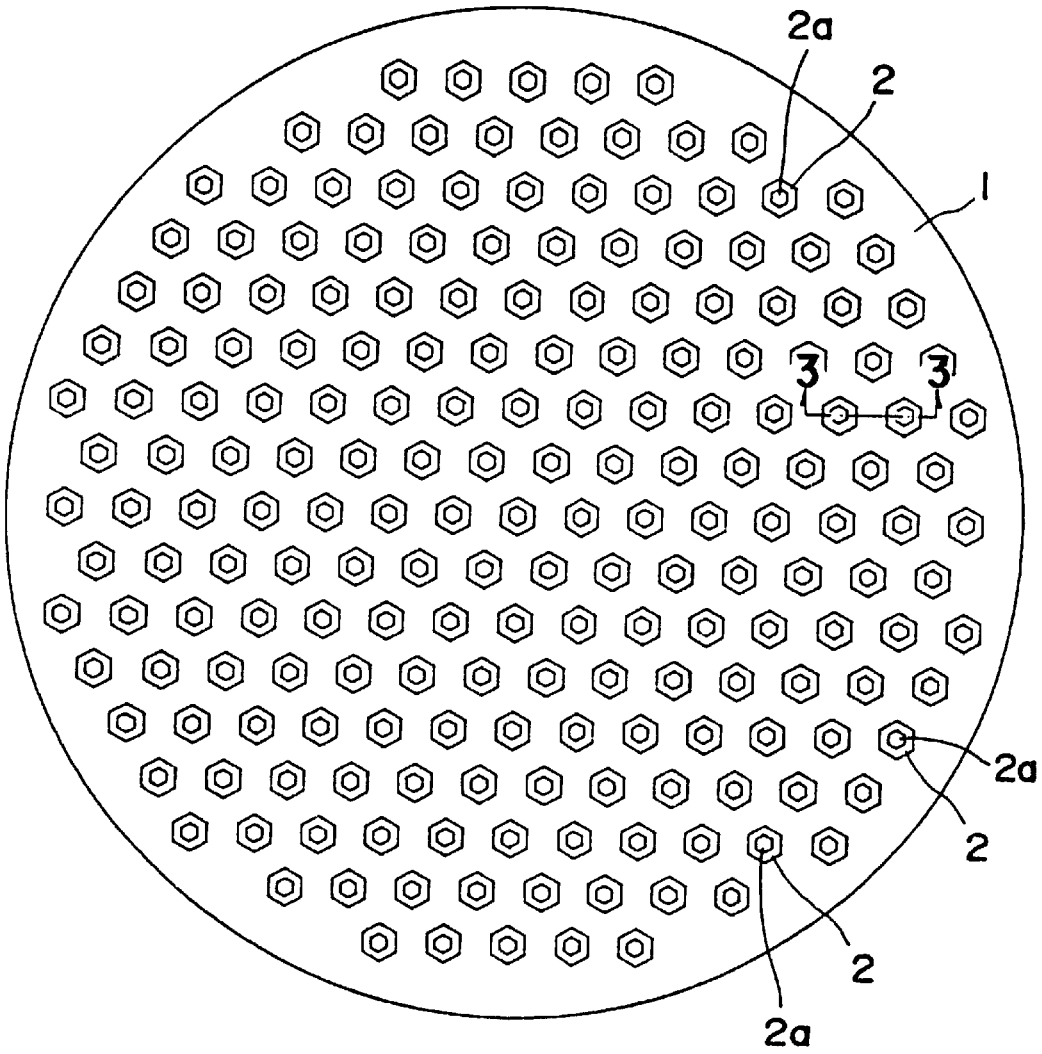
FIG. 1 is a schematic plan view of a cover for underground structures of an embodiment in accordance with this invention.

In addition to the foregoing construction, it is possible to have another construction of the cover body in accordance with the present invention, wherein projections and/or small protrusions having sharp-angle edges are disposed on at least some of the surface thereof.

Moreover, the cover body for underground structures wherein the patterns of projections and depressions are formed on the surface thereof by means of a plurality of projections and depressions may be of such construction that projections having sharp-angle edges are arranged on at least one some of the surface thereof, and that small protrusions are further formed on the top surface of some or all of the projections with the projections and/or small protrusions having sharp-angle edges provided upon at least one some of the surface of the cover body.

In regard to at least one of the projections with small protrusions formed thereon, the level of the above-mentioned projections may be higher than that of other projections on which small protrusions are formed.

It is to be noted that the pitch of the outlines between projections and small protrusions independently formed on the surface of the cover body approximately corresponds to a pitch of the points of action of the engaging force subject to the repeated loads of tires, as vehicles pass over the cover body. Consequently, it is possible to determine the mode of action of the engaging force best suited to the tires by determining how the engaging force acts on the tires according to the length of pitches of the outlines between mutually adjacent projections or mutually adjacent small protrusions.

The present invention specifies the pitch of the outlines between the projections and between small protrusions as well as the shapes of such which are best suited in terms of such mode of action of the engaging force with tires, and the desired object of the present invention is accomplished if at least one of the pitches of the outlines between the adjacent protruding parts including small protrusions is set to be in a range of 10 mm to 30 mm, while the planar shape of the topmost surfaces of the protruding parts is such as to be contained in a diameter of 25 mm. Also, the engaging force with the cover body with sharp-angle edges provided on the outer periphery side of the projections and the small protrusions is reinforced due to the sharp-angle edges.

The small protrusions and edges, when formed on all the projections established on the cover body, will offer the best slip and skid prevention effect over the entire surface of the cover body, and in the case of forming such portions on some of the projections, an arrangement of such portions uniformly over the surface thereof will enhance the effect of slip and skid prevention.

It will be appreciated that as far as at least one of the above-mentioned projections on which small protrusions are formed on a level higher than that of the other projections on which small protrusions are formed, the small protrusions will wear out, so that the surfacing time of the above-mentioned projections can be used as a measure of ashen to replace the cover body. Namely, upon surfacing of the above-mentioned projections, the small protrusions formed on other projections are still remaining, whereby this time is used as a criterion of the period of replacement of the cover body, degradation of the anti-slip and anti-skid performance can be prevented.

FIG. 1 is a plan view of a body of a cover for underground structures according to the present invention. A cover body 1 is conventionally taper-fit to a frame (not illustrated herein) set underground, and on a surface thereof are independently formed projections 2 of a planar regular hexagon shape with sides of the outlines of the projections 2 so disposed to be parallel to those of other adjacent projections, whereas small protrusions 2*a* in a reduced planar outline shape of a projection 2 stick out at a uniform level from the surface of all projections 2, as shown in FIG. 2.

Figure 2A:
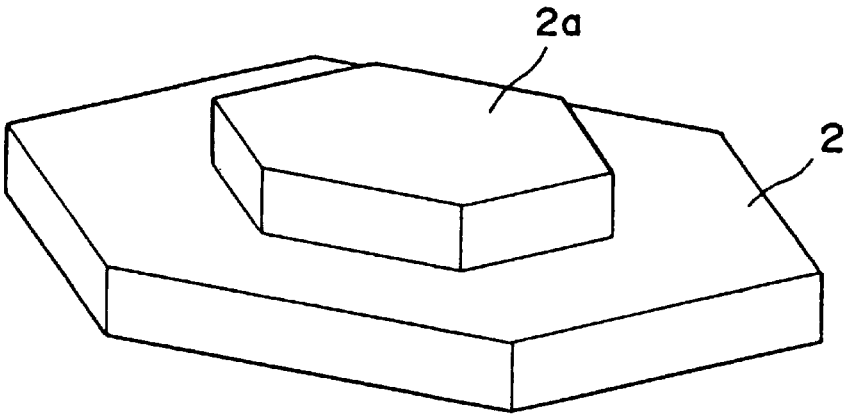
FIG. 2(*a*) is a perspective view.
Figure 2B:
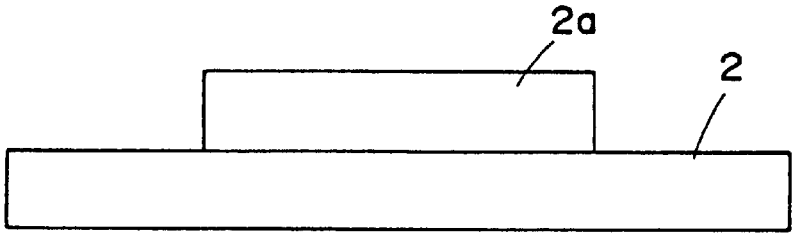

As clearly illustrated by FIG. 2, the projection 2 is formed at a uniform level in a planar regular hexagon shape, a small protrusion 2*a* being in a relationship of similarity to an outline shape of the projection 2 with the top surface thereof uniformly flat. It is to be noted that the level of each top surface of each small protrusion 2*a* is designed to be identical.

Figure 3:
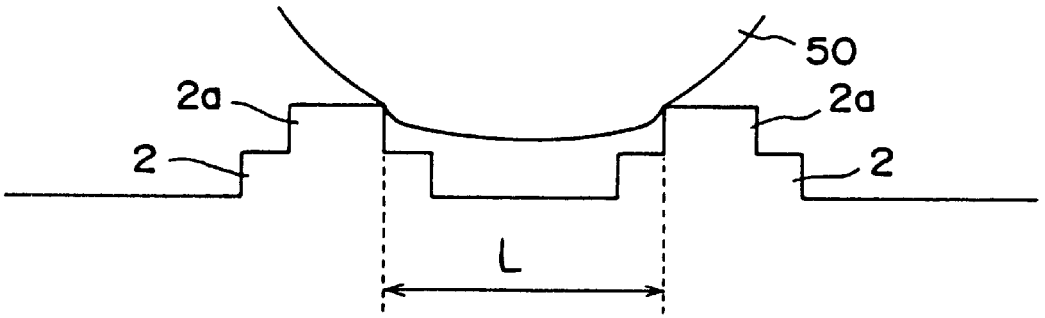
FIG. 3 illustrates conceptually shapes and a positional relationship of projections and small protrusions of the embodiment of FIG. 1 taken along line 3—3.

FIG. 3 is a view equivalent to a longitudinal section in the direction of the arrows substantially along line III—III; conceptually illustrating a positional relationship of mutually adjacent projections 2 with small protrusions 2*a*, together with an outline of a tire 50. This embodiment is constructed to meet the requirements that a pitch L between the mutually adjacent outlines of one small protrusion 2*a* formed on one projection 2 and another be set in a range from 10 mm to 30 mm, and that the top surface in a planar shape of all small protrusions 2*a* be included in a circle of a diameter of 25 mm.

The projections 2 are arranged over the surface of the cover body 1 in the embodiment. It is to be understood that when marks such as a municipal mark or characters are to be placed on the cover body 1 or when an edge is provided on the outer periphery, the projections 2 are disposed on the area excluding such items. It is also illustrated that the small protrusions are formed on all of the projections 2. But, a pattern wherein part of the projections 2 are dispersed is acceptable, although the levels of small protrusions 2*a* and the projections 2 on which no small protrusions are formed are preferably identical.

Figure 4A:
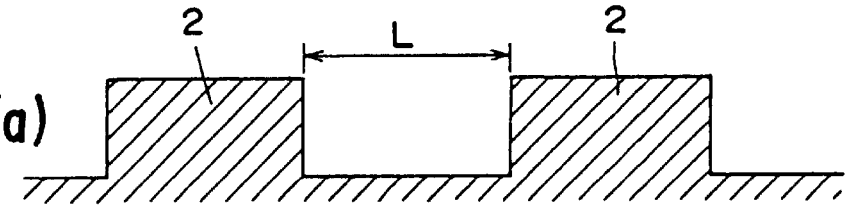
FIGS. 4(*a*)–4(*c*) are longitudinal sections showing pitches L relative to arrangements of projections for purposes of defining the pitches L between projections of varying shapes of longitudinal sections.
Figure 4B:
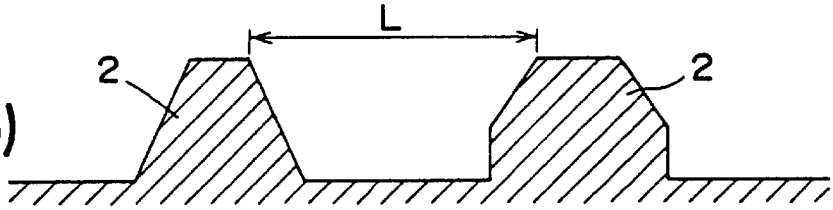
Figure 4C:
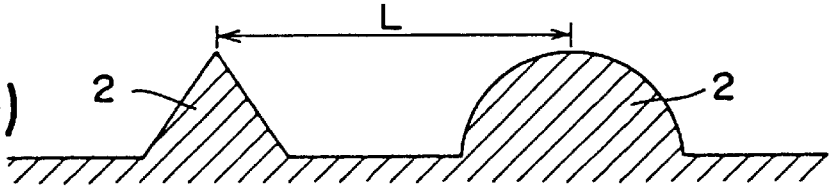

Referring to FIGS. 4(*a*)–4(*c*) and 5(*a*) and 5(*b*) there are shown illustrations to define the pitch L between the outlines of one projection and another in accordance with this invention. For the sake of simplifying description, a pitch L between projections with no formation of small protrusions 2*a* is shown.

In this invention, the length between points of engagement with a tire on a projection 2 and another projection 2 shall be a basic unit regardless of the shape of longitudinal section of the projections 2. That is, in the case of a rectangular shape in a longitudinal section as shown in FIG. 4(*a*), the basic unit shall be the length between the corners forming upper edges, whereas in the case of a trapezoidal shape in the longitudinal section, the basic unit shall likewise be the length between the corners of upper edges. Further, in the case of a triangle or a spherical shape of longitudinal section in FIG. 4(*c*), the basic unit shall be the length between the points on the respective highest levels.

Figure 5A:
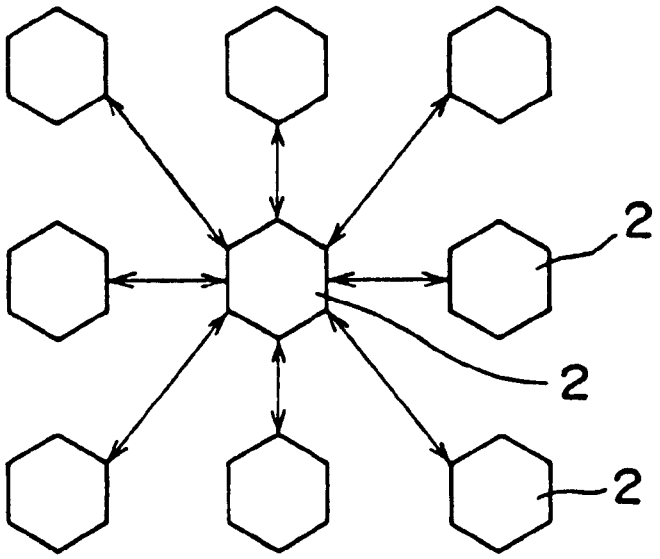
FIGS. 5(*a*) and 5(*b*) are plan views showing pitches L relative to arrangements of projections to define the pitch L between projections.
Figure 5B:
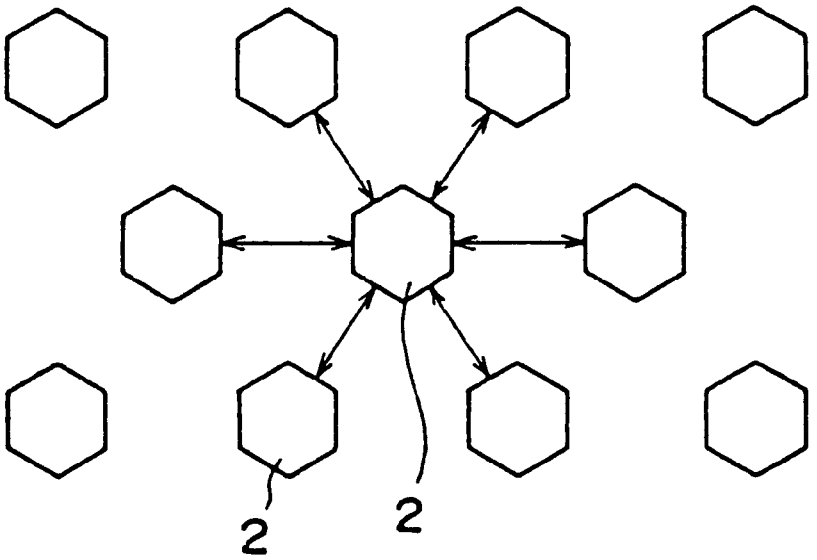

In addition to the length between points of engagement with the tire as shown in FIG. 4 as the definition of the pitch L between projections 2, there is another condition of the pitch L as the length of a line portion equivalent to the mutually shortest distance. Namely, as shown in FIG. 5, when the projections 2 are in a planar shape of hexagon, for respective cases of a lattice-like arrangement of the projections 2 of FIG. 5(*a*) and an offset arrangement thereof of FIG. 5(*b*), the length equivalent to the line portion with the arrows in respective views shall be the pitch. For instance, when the lattice-like arrangement is employed, the length between the corners or the facing sides shall be the pitch L, while the length between the facing sides shall be the pitch L for all cases of the offset arrangement.

At this point, as explained in connection with the embodiment of FIG. 1, there is the following basis of requirements which set the pitch L of the outlines between mutually adjacent small protrusions 2*a* as anywhere from 10 mm to 30 mm, and which stipulates that as far as all small protrusions 2*a* or the projections 2 on which no small protrusions 2*a* are formed are concerned, the topmost surface of such protrusions and projections in a planar shape should be of a size containable within a circle of a diameter of 25 mm.

Inasmuch as these requirements on the pitch L and the size of the planar shape including the projections 2 and the small protrusions 2*a* according to this invention concern the arrangement pattern and shape of the protruding parts, the following description will be made by referring to the projections and the small protrusions simply as the general term of "Protruding Part(s)."

For the cover body 1 of manhole covers installed on general roads to effectively prevent slipping and skidding of tires of vehicles, one criterion is that the frictional resistance thereof should be at least equal to the frictional resistance of the road surface wet with rain and other matter. The frictional resistance of a road surface wet with rain and other matter of general roads is supposed to be within a range from 0.45 to 0.6, for example, according to the Safety Driving Traffic Manual (published by the Safety Driving Control Association of Home Delivery Businesses Including Pizza Delivery, p. 7). Consequently, this invention specifies the shape of the protruding parts of the cover body 1 and the arrangement patterns of such parts so that the frictional resistance against the tires shall be in excess of 0.45.

In other words, when a large frictional resistance exceeding 0.45 is designated, not only is it important to increase the number of points on which the tire comes to engage the protruding parts of the cover body 1 when the tire passes the surface thereof, but also to deform the tire sufficiently. The following phenomena were verified after the inventor researched the relationship of frictional resistance against tires and the pitch L, as well as the size of the topmost surfaces of the protruding parts.

(1) When the pitch L is too small, tire deformation decreases and the gripping force is reduced.

(2) When the pitch L is too large, the tire comes into contact with the bottom surface of the recess between the protruding parts of the cover body 1, with the result that the tire deformation decreases or the tire only passes on the bottom surface so that tire deformation is not prompted. This phenomenon is particular noticeable on narrow treads.

(3) When the dimension of the topmost surface of the protruding parts is too large, the number of points on which the tire comes to engage decreases relative to the whole dimension of the cover body 1, and the repetition of tire deformation when the tire passes over the surface of the cover body 1 also decreases.

In view of the foregoing, it is apparent that proper settings are needed in regard to the pitch between the protruding parts and the size of the topmost surfaces of such parts if the necessary frictional resistance is to be obtained. After conducting due research and examination of the relationship among the pitch L, the size of the topmost surfaces of the protruding parts, and frictional resistance including relevancy of the types of tires, the inventor has come to the conclusion that so long as the requirements that the pitch L to be in a range from 10 mm to 30 mm and that the size of the topmost surfaces of the protruding parts be such as to be fit within a circle of a diameter of 25 mm are met, frictional resistance will be in excess of 0.45.

It is apparent that the smaller the topmost surface shape of the protruding part is, the more engaging power with the tire is produced, and the more slip and skid prevention effect is obtained. From this standpoint, the most effective method is to shape the protruding part into, for example, a tip portion tapering off in the longitudinal section of the triangular shape shown in FIG. 4(*c*). In this case, the part in engagement with the tire is a point or, to be specific, a flat area of naught, thus meeting one of the requirements that the size of the topmost surface be such as to fit within a circle of a diameter of 25 mm.

On the other hand, regarding the level of the protruding part, if such level should be extremely low, the tire would contact the bottom surface of the recessed part as in the case of the excess pitch L, so that the slip and skid prevention effect due to tire deformation becomes insufficient. Accordingly, even empirically speaking, it is proper to set the level of the protruding part in excess of 1 mm to maintain at least a minimum of slip and skid prevention effect. In actuality, should the level thereof be exceeding 6 mm, there is a disadvantage in that the protruding part tends to break. Likewise, from an empirically standpoint, it is desirable to set approximately 6 mm as the maximum level thereof. Hence, it is preferable according to this invention that the level of the protruding part be set at a range from 1 mm to 6 mm, regardless of the planar shape thereof.

When a small protrusion 2*a* is formed on the top surface of a projection 2 as in this embodiment, it is preferable to set the respective levels of the projection 2 and the small protrusion 2*a* in the range from 1 mm to 6 mm. In other words, when the protruding part comprises a plurality of steps, the respective levels of the steps are preferably set in the range from 1 mm to 6 mm As mentioned above, as far as the protruding part is concerned, in addition to the conditions stipulating that the size of the topmost surface thereof has a planar shape fitting within a circle of a diameter of 25 mm and that the pitch L as defined above is provided between the adjacent protruding parts, meeting a further condition of 1 mm to 6 mm for the level thereof will bring about the best effect on slip and skid prevention.

Moreover, it is to be understood in this embodiment that, as FIG. 3 illustrates, each ratio of the level of the small protrusion 2*a* to the level up to the top surface of the projection 2 and that of the small protrusion 2*a*'s planar area to the projection 2's planar area are approximately to an extent that the tire 50 is in engagement with only the small protrusion 2*a* with the small protrusion 2*a* not in a worn-out state as illustrated and that the tire 50 is not in contact with the top surface of the projection 2.

In view of the foregoing even if the small protrusion 2*a* gradually wears out, the projection 2 positioned at the step thereunder comes into contact with the tire 50. Therefore, even if the engaging force with the tire 50 diminishes as a result of the wearing out of the small protrusion 2*a* to cause the corners thereof to be rounded, a new engaging force due to the corners of the projection 2 will come to action, thereby checking any drop in slip and skid prevention effect and enabling the service life of the cover body 1 to be extended. As a result, even in an installation environment subject to a large number of passing vehicles, the effect of slip and skid prevention is maintained over a long period of time. In this case, it goes without saying that the optimum procedures are to set not only the pitch between the outlines of two adjacent small protrusions 2*a* but also that of the outlines of two adjacent projections 2 positioned at the next lower level at a range from 10 mm to 30 mm.

Figure 6:
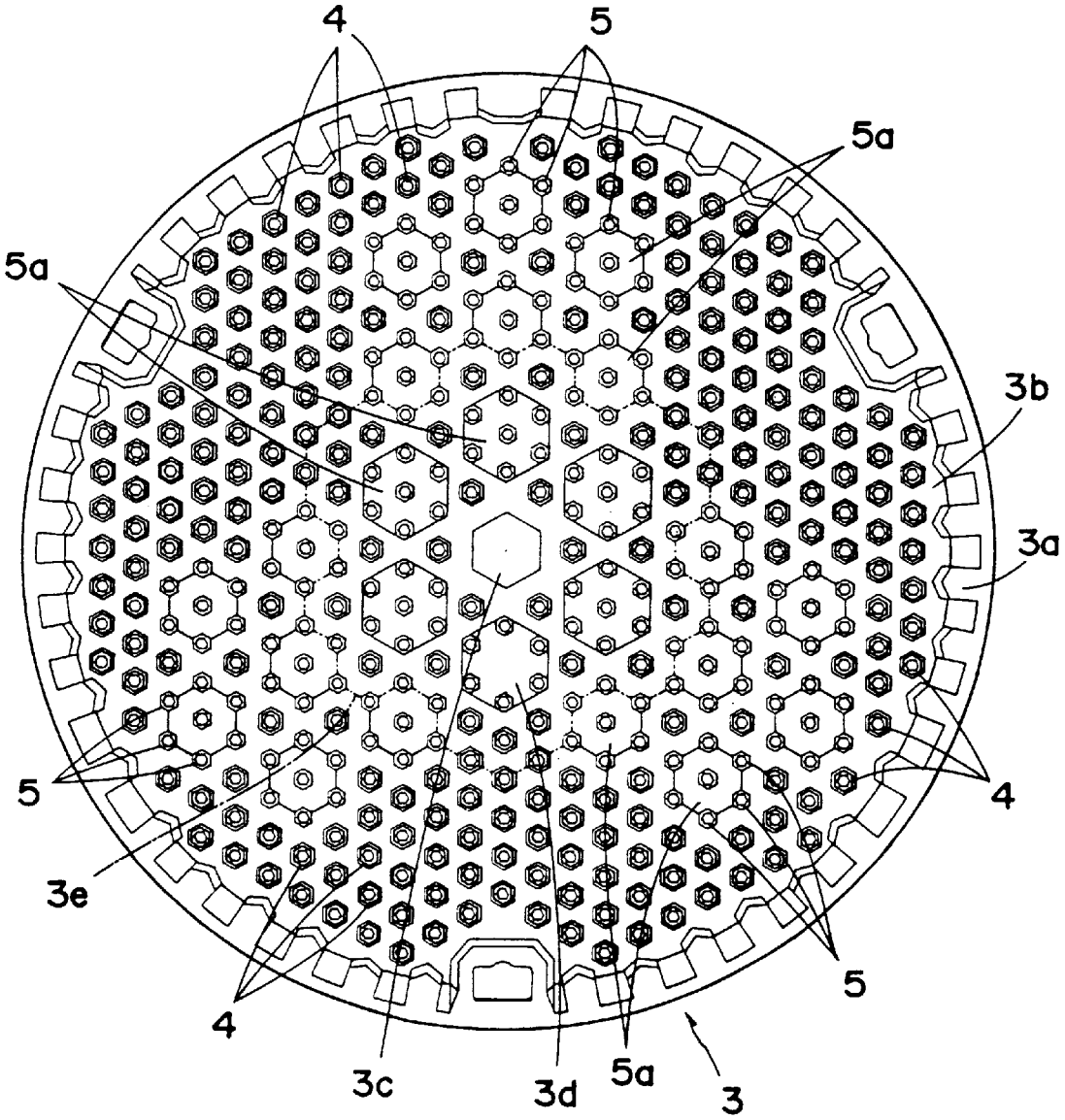
FIG. 6 is a plan view of another embodiment of this invention.

FIG. 6 is a plan view showing another embodiment of this invention. A cover body 3 has the periphery thereof as a highest-level edge 3*a* and the part excluding this edge 3*a* is formed as a uniformly flat base 3*b* having a surface shape, wherein two types of protruding parts 4 and 5 are dispersed.

In FIG. 6, a mark seat 3*c* and character seats 3*d* are provided on the central part of the cover body 3, so that a mark such as a municipal seal or characters and symbols indicating use of the cover body 3 and other matters are respectively put into the mark seat 3*c* and the character seats 3*d*.

Figure 7A:
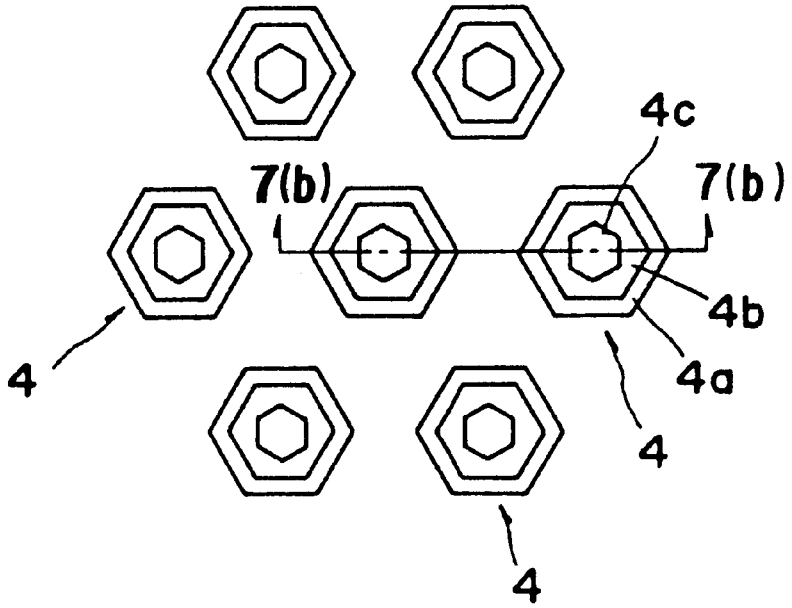
FIG. 7(*a*) shows a plan view of an arrangement example thereof.
Figure 7B:
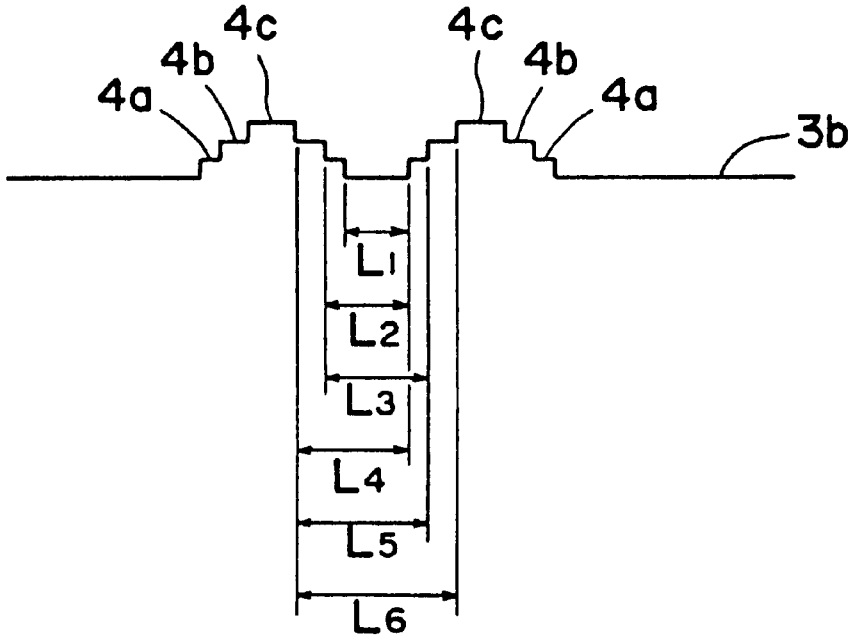

As shown by the detail view of FIG. 7(*a*) and FIG. 7(*b*), a protruding part 4 is formed in a planar shape directly rising from the base 3*b* with a hexagonal projection 4*a* with additional planar shapes forming respectively two levels of small protrusions 4*b* and 4*c* in hexagonal shapes. The projection 4*a* and the small protrusion 4*b* thereon are respectively in agreement with a hexagonal posture, the small protrusion 4*c* of the topmost level being in a posture rotated 30 degrees relative to the small protrusion 4*b* thereunder and the projection 4*a* to position the corners thereof differently. By making the corners of the small protrusion 4*c* of the topmost level take a different position than the corners of the small protrusion 4*b* thereunder and the projection 4*a*, despite a variety of advancing directions of tires, the engaging force by the protruding part 4 as a whole is increased, thus holding the slip and skid prevention effect at high levels.

In the protruding part 4 of such a shape, the planar shape of the small protrusion 4*c* of the topmost level is of a size to be contained within a circle of a diameter of 25 mm, and the pitch thereof may be such that either one of the dimensions L1 to L6 shown in FIG. 7(*b*) only needs to be in the range from 10 mm to 30 mm. However, the pitch L6 between the adjacent small protrusions 4*c* of the topmost level should preferably be in the range from 10 mm to 30 mm. It is to be noted that in this embodiment, each of L2 to L6 excluding the pitch L1 between the projections 4*a* is set at a value in the range from 10 mm to 30 mm. Also, the levels of the projection 4*a* and the prominent portions of the small protrusions 4*b* and 4*c* are respectively 2 mm, the level of the entire protruding part 4 from the base 3*b* up is 6 mm.

Figure 8A:
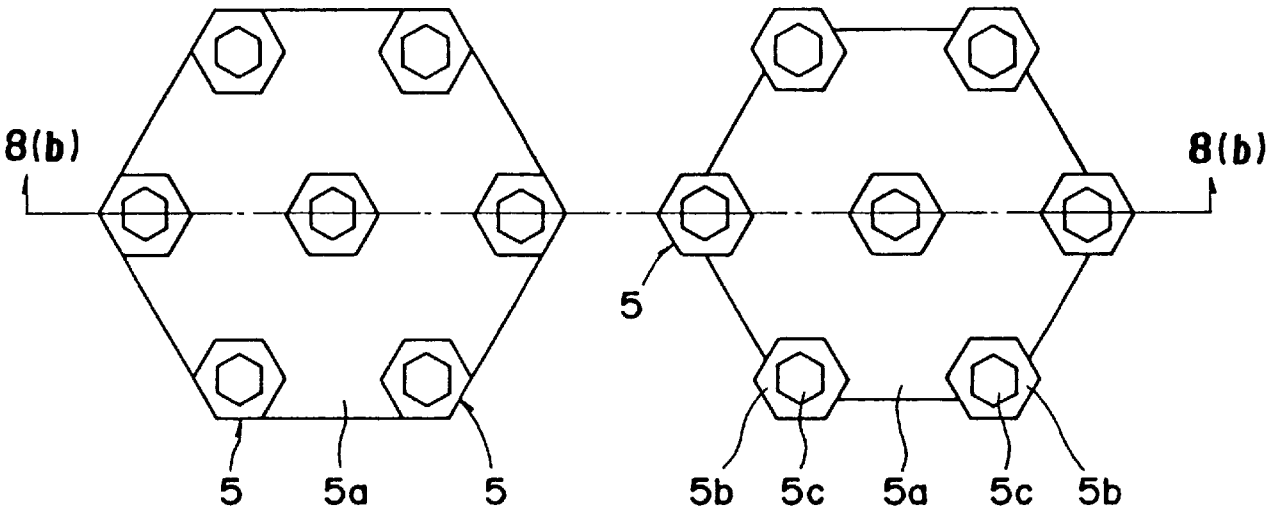
FIG. 8(*a*) shows a plan view of an arrangement example thereof.
Figure 8B:
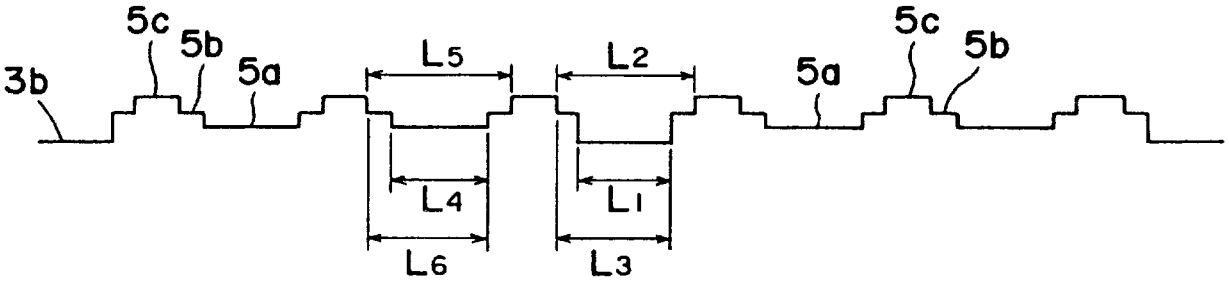

Another type of protruding part 5, as shown by a detail view in FIGS. 8(*a*) and 8(*b*), has a shape of two levels of small protrusions 5*b* and 5*c* laid over a projection 5*a* in a planar shaped hexagon. As shown in FIG. 6, these projections 5*a* are dispersed in a one-sided way near the central part side of the cover body 3, each having a set of seven small protrusions 5*b* and 5*c* formed thereon. These small protrusions 5*b* and 5*c* are in the same planar hexagon as other projections 4, the top level small protrusion 5*c* taking a posture rotating 30 degrees relative to the small protrusion 5*b* thereunder.

In this protruding part 5, the level of the prominent portion from the base 3*b* is 6 mm, the level of the prominent portions of the small protrusions 5*b* and 5*c* is 2 mm. The planar shape of the top level small protrusion 5*c* is of a size containable within a circle of a diameter of 25 mm in the same way as the protruding part 4. The pitches L1 to L6 shown in FIG. 8(*b*) can be respectively set in a range from 10 mm to 30 mm, and this same setting can be established for one of the respective sets of L1 to L3 and L4 to L6. However, the setting of 10 mm to 30 mm is preferable for the pitches L2 and L5 between the mutually adjacent topmost level small protrusions 5*c*. Note that the illustrated embodiment is based on the relationships of L1=L4=12 mm, L2=L5=19 mm, and L3=L6=16 mm.

As described above, even the projections 4*a* and 5*a* with the small protrusions 4*b*, 4*c*, 5*b*, and 5*c* respectively formed on them permit an engaging force, due to tire deformation, to act effectively by meeting the condition of the pitch L; and since the engaging force due to the corners of the small protrusions 4*b*, 4*c*, 5*b*, and 5*c* or the projections 4*a* and 5*a* is made to act, slip and skid prevention can be enhanced.

It will be appreciated that the region enclosed by the long and dotted demarcation lines in FIG. 6 can be treated as a bass pattern 3*e* formed at a level of about 1 mm from the base 3*b*. This base pattern 3*e* is established also, for example, for the purpose of prompting discharge of water toward the edge 3*a* of the cover body 3, although the protruding parts 4 and 5 are disposed on the top surface of the base 3*b* and the base pattern 3*e* have the same level of respective topmost surfaces.

In the above-mentioned embodiment, the pitch L between the mutually adjacent projections and that of the mutually adjacent small protrusions as well as the size of the topmost surfaces are designated to improve the anti-slip and anti-skid performance. In addition to this construction, another procedure may be used, wherein fine protrusions and recesses which are conventionally employed are provided on the top surface of the projections and the small protrusions to enlarge the surface coarseness of the projections and the small protrusions.

Figure 9:
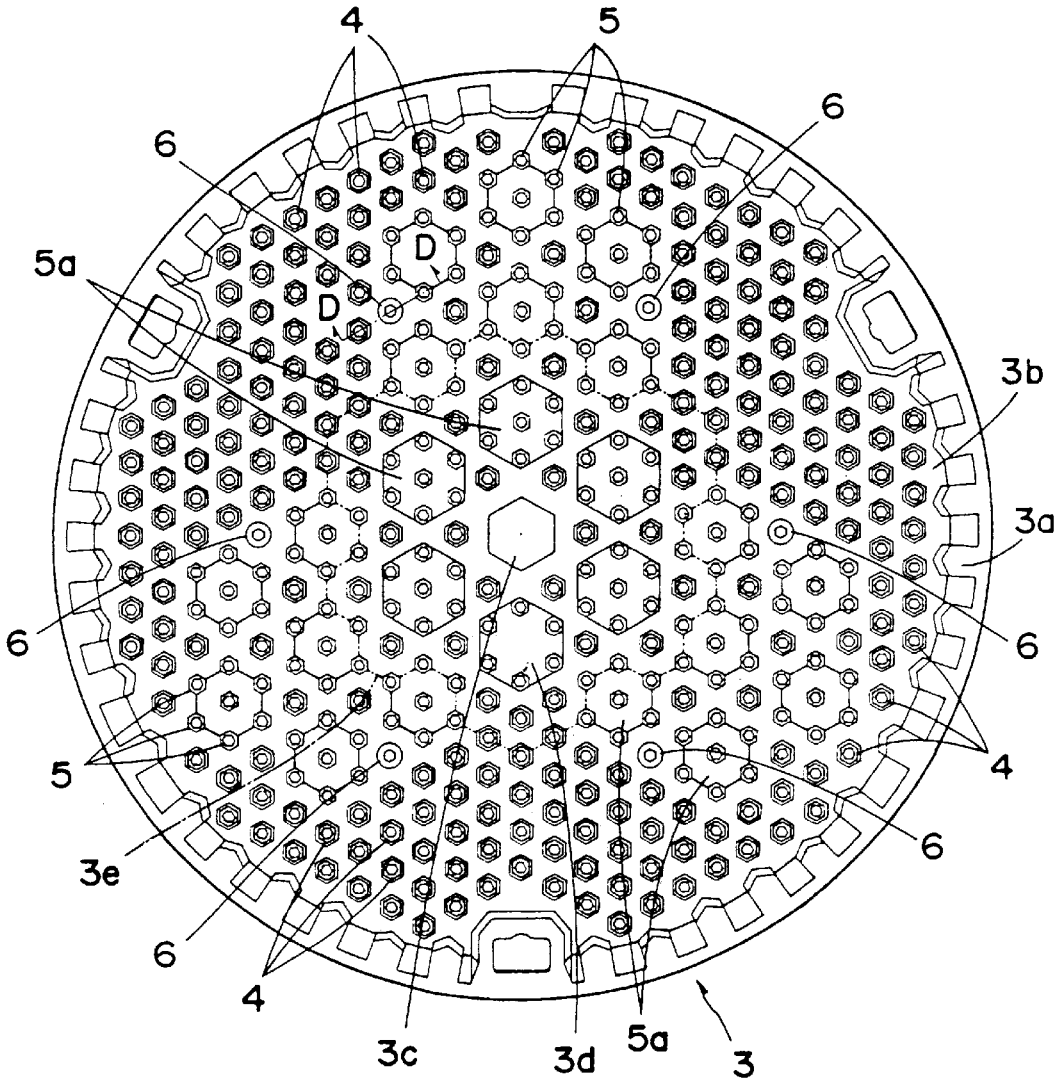
FIG. 9 is a plan view of another embodiment of this invention.

FIG. 9 shows still another embodiment, wherein some of the protruding parts 4 shown in the previous embodiment from FIG. 6 to FIG. 8 are replaced with different protruding parts 6. The parts or portions of this embodiment, which are the same as those shown in the previous embodiment, are shown in the same numbers and symbols, thus a detailed description thereof is omitted.

As shown in FIG. 9, in this embodiment, six protruding parts 6 are uniformly arranged at positions which are substantially in the middle between the central part of the cover body 3 and the edge 3*a*. As shown in the detail views of FIGS. 10(*a*) and 10(*b*), a protruding part 6 is formed of a projection 8, in a circular planar shape as well as a small protrusion 6*b* in a planar hexagon shape, the top surface of the small protrusion 6*b* being formed on the same level as that of the top surfaces of the topmost small protrusions 4*c* and 5*c* of the other protruding parts 4 and 5. The prominent portion of the small protrusion 6*b* is made longer than that of the small protrusions 4*c* and 5*c* of the other protruding parts 4 and 5, and the level of the top surface of the projection 6*a* thereunder is formed lower than that of the small protrusions 4*b* and 5*b* of the other protruding parts 4 and 5 but higher than that of the protrusion 4*a* of the protruding part 4 and the protrusion 5*a* of the protruding part 5.

Figure 10A:
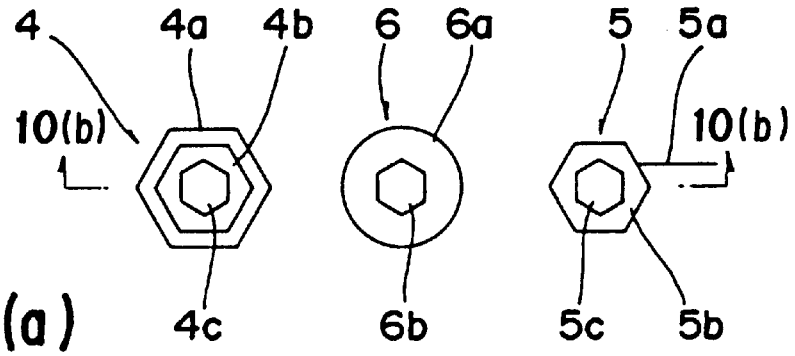
FIG. 10(*a*) is a plan view of an arrangement example thereof.
Figure 10B:
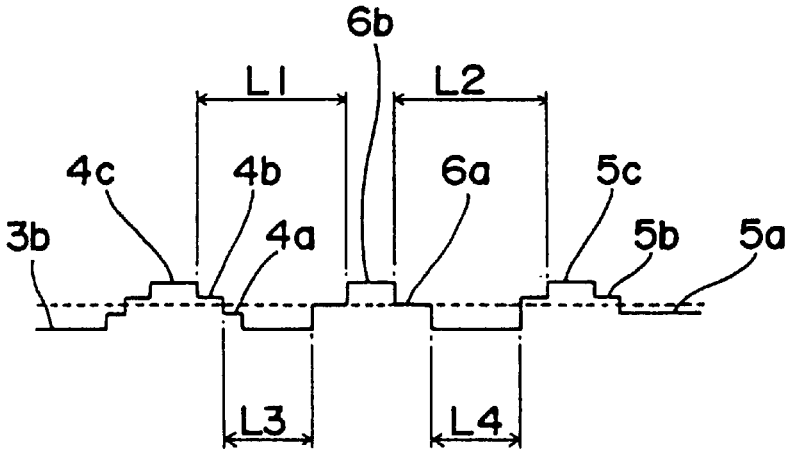

In this embodiment, the pitches L (L1, L2, L3, and L4 of FIG. 10(*b*)) between the outlines of the mutually adjacent protruding parts are respectively set in the range from 10 mm to 30 mm. Since the planar shape of the topmost level small protrusions 4*c*, 5*c*, and 6*b* is such as to be contained within a circle of a diameter of 25 mm, such protrusions are endowed with the slip and skid prevention effect in the same way as the previous embodiment.

Figure 11:
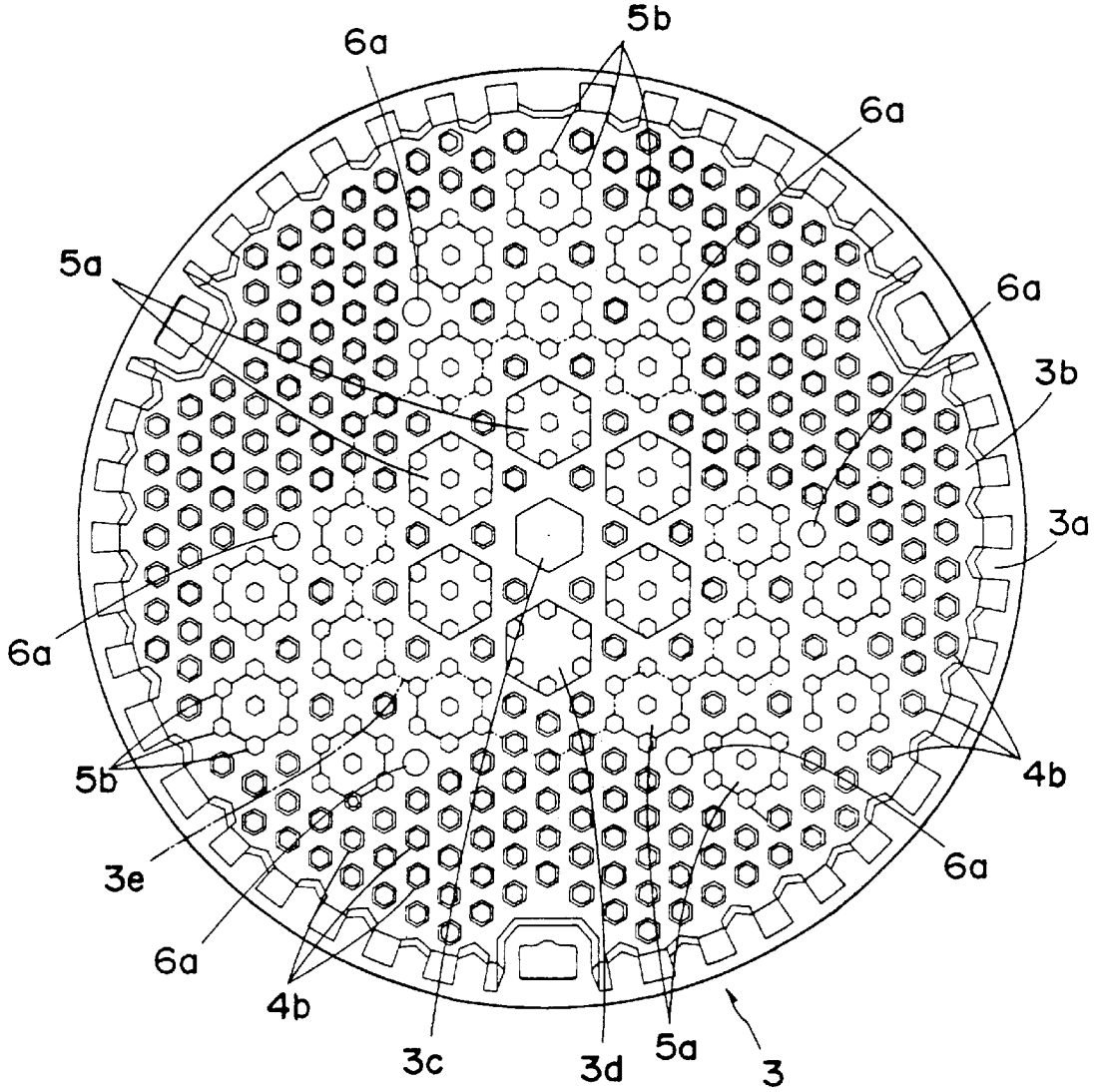
FIG. 11 is a plan view of the protruding parts of FIG. 9 in a worn-out state.

FIG. 11 is a plan view showing the worn-out state of the protruding parts 4, 5, and 6 of FIG. 9 which have lost the length of the prominent portions of the small protrusions 6*b* of the protruding parts 6. When abrasion proceeds to the extent that the small protrusions 6*b* are lost, the position of the topmost surface of each of the protruding parts 4, 5, and 6 becomes the position shown in a broken line of FIG. 10, whereupon the second level small protrusions 4*b* and 5*b* on top of the protruding parts 4 and 5 as well as the projection 6*a* of the protruding part 6 surface.

Upon surfacing of the projection 6*a,* the small protrusions 4*b* and 5*b,* which are formed on the other projections 4*a* and 5*a,* are still remaining, wherefore some degree of anti-slip and anti-skid performance is maintained. However, because abrasion exceeding this degree would result in removal of the small protrusions 4*b* and 5*b,* thus considerably diminishing anti-slip and anti-skid performance, the surfacing time of the projection 6*a* serves as a criterion of the replacement period of the cover body 3.

When the level of the projection 6*a* of the protruding part 6 is higher than that of the projections 4*a* and 5*a* of the other protruding parts 4 and 5, the surfacing time of the projection 6*a* shows a measure of time for replacing the cover body 3, so that when this point in time is used as the criterion and the cover body 3 is replaced, degradation of anti-slip and anti-skid performance is prevented. Also, since in the embodiment, the planar shape of the projection 6*a* of the protruding part bears no similarity to that of the projections 4 and 5*a* of the other protruding parts 4 and 5 as well as that of the small protrusions 4*b* and 5*b,* the projection 6*a*, when surfacing due to abrasion, becomes noticeable enough to make it possible to discover the surfacing thereof with ease.

Further, the pitches L3 and L4 between the small protrusions 4*b,* 5*b* and between the projections 6*a* which are on the topmost level in the surfacing state of the projections 6*a* in FIG. 11 are, as mentioned above, in the range from 10 mm to 30 mm, and the planar shape of such protrusions and projection is in such a size as to be included in a circle of a diameter of 25 mm. Consequently, the effect of slip and skid prevention continues to be sufficiently maintained.

Although six protruding parts 6 are uniformly placed on the surface of the cover body 3 in this embodiment, the number and method of arrangement of the protruding parts 6 may not be confined to this example. Arranging a plurality of the protruding parts 6 uniformly is preferable, however, to determine the degree of abrasion or the degree of one-sided abrasion on the entire surface of the cover body 3.

Figure 12A:
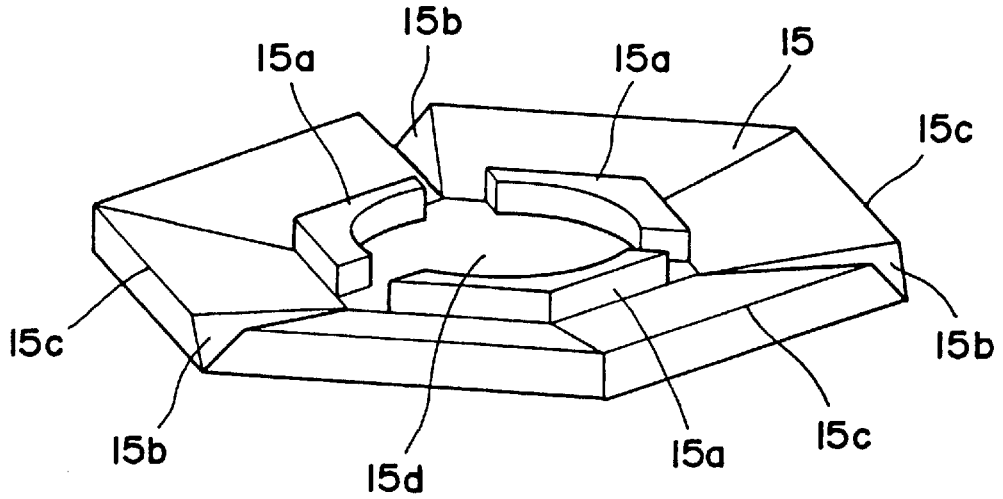
FIGS. 12(*a*) and 12(*b*) show specific example of forming small protrusions at three locations on the top surface of a projection with an outer rim thereof as an edge.
Figure 12B:
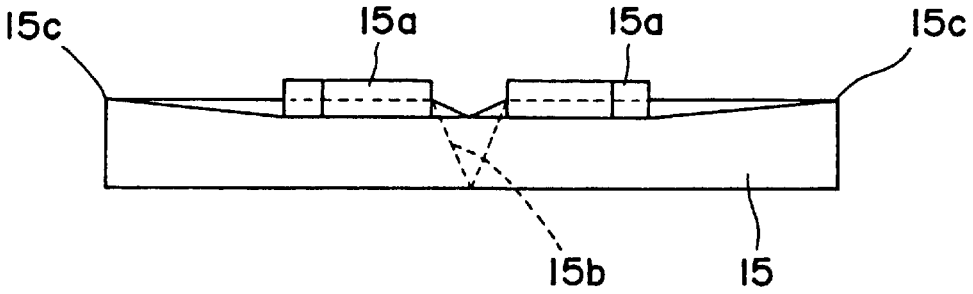
Figure 13A:
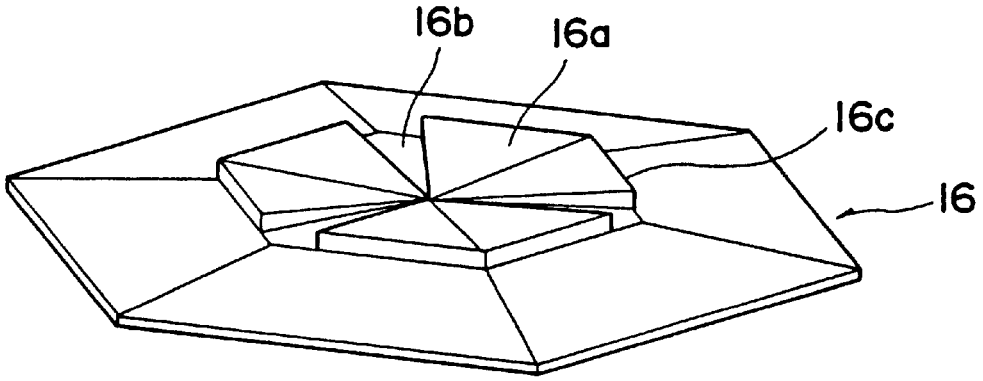
FIGS. 13(*a*) and 13(*b*) show a specific example of forming small protrusions at three locations on the top surface of a projection with an outer rim of the projection as an edge.
Figure 13B:
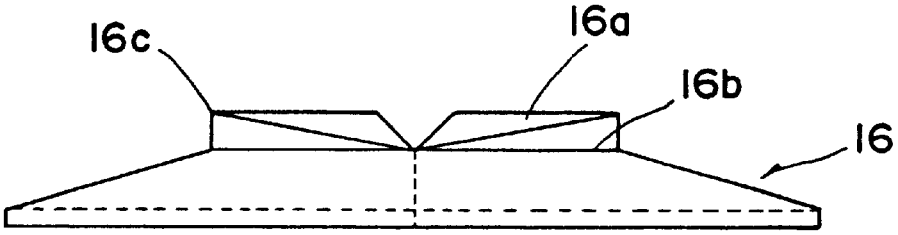

FIGS. 12(*a*) and 12(*b*) and FIGS. 13(*a*) and 13(*b*) show examples, wherein engaging force with tires is increased by improving the shape of respective projections to prevent slipping and skidding. An example of FIGS. 12(*a*) and 12(*b*) presents the formation of three small protrusions 15*a* arranged in a ring-like fashion on the central part of a hexagonal projection 15, with sharp-angle edges 15*c* for an outer rim thereof. The edges 15*c* are positioned on the edge of a surface sloped upward from a border with the small protrusions 15*a*, and the level of the edges 15*c* are, as shown in FIG. 12(*b*), slightly lower than the upper surface of the small protrusions 15*a* which are disposed on the upper surface of the central part of the projection 15 in the manner of forming a small recess 15*d* of a substantially circular shape.

The provision of such sharp-angle edges 15*c* makes it possible to increase the engaging force with tires, for example, beyond that shown in FIG. 2. Since small protrusions 15*a* sticking up from the central side are formed, the prominence of the small protrusions 15*a* contributes to increasing the engaging force with tires.

Moreover, even if rainwater, dirt and other matter should collect in the small recess 15*d,* drainage grooves 15*b* are formed toward the outer rim of the projection 15 to enable such accumulations to be quickly discharged to the outside, hence the effect of slip and skid prevention is not impaired.

An example in FIG. 13 shows three small protrusions 16*a* arranged on the central part of the projection 16 with the formation of a sloped surface on the upper surface of the small protrusions 16*a* in a manner of elevating an outer rim of the small protrusions 16*a*, sharp-angle edges 16*c* serving as the outer rim. In this example, too, discharge of rainwater and dirt is promoted through drainage grooves 16*b* among the small protrusions 16*a*, and due to the effect of the sharp-angle edges 16*c* formed on the small protrusions 16*a*, and the engaging force with tires is strengthened, thereby achieving slip and skid prevention effectively.

As these examples in FIGS. 12(*a*)–13(*b*) show, formation of edges on the outer rim of the projections and the small protrusions considerably reinforces the engaging force with tires, so that even if the pitches L between the outlines of the mutually adjacent projections and between the outlines of small protrusions should not entirely fall within the range of 10 mm to 30 mm, the desired object of slip and skid prevention is accomplished. Accordingly, a degree of freedom of arranging the projections is increased and variations are acquired by partially placing projections 15 over the cover body 1. However, when the projections having sharp-angle edges are partially disposed, it is preferable to arrange such portions uniformly over the surface of the cover body from the standpoint of slip and skid prevention. Needless to say, it is preferable to establish the settings of 10 mm to 30 mm for the pitches L between the mutually adjacent projections and between the mutually adjacent small protrusions, all having sharp-angle edges.

Cover bodies with a round shape were described above in reference to the embodiments. Naturally, angular cover bodies are equally acceptable.

According to this invention, by setting one of the minimum pitches between the outlines of the independently formed projections as well as between those of the small protrusions provided on the top surfaces of such projections within the range of 10 mm to 30 mm as well as the size of the topmost surface in a planar shape includable within a circle of a diameter of 25 mm, the engaging force due to tire deformation is effectively put to operation to inhibit the generation of slipping and skidding. Also, by setting up small protrusions on top of the projections, the engaging force due to the angular portions of the small protrusions or the projections, in addition to the engaging force due to tire deformation, is rendered to act, thus enhancing the slip and skid prevention effect even more and inhibiting a decrease in the slip and skid prevention effect due to abrasion of the small protrusions as well.

Furthermore, those cover bodies having the formation of sharp-angle edges on the projections and small protrusions, since the sharp-angle portions increase the engaging force with tires, maintain the slip and skid prevention effect on high levels as compared to those cover bodies on the surface of which are merely arranged flat projections and small protrusions. In addition, if the minimum pitches between the outlines of the mutually adjacent projections and between those of the mutually adjacent small protrusions forming such edges are set within the range of 10 mm to 30 mm, the slip and skid prevention effect will increase even further.

As for at least one of the projections on which small protrusions are formed, when the level of the above-mentioned projections is formed higher than that of the other projections on which small protrusions are formed, surfacing of the above-mentioned projections due to abrasion serves as a criterion of when to replace the cover body. As result, if this is used as an indication for replacing the cover body, a drop in anti-slip and anti-skid performance is prevented.

It will be apparent to those skilled in the art that many variations and modifications may be made to the preferred embodiments as described above without substantially departing from the principles of the present invention. All such variations and modifications are intended to be included herein and within the scope of the present invention, as set forth in the following claims.

What is claimed is:

1. A cover for underground structures comprising:

a cover body having a surface;

mutually independent projections arranged uniformly over the surface of the cover body;

said projections having side surfaces and first top surfaces and protrusions formed on said first top surfaces of at least some of said projections, said protrusions having side surfaces and second top surfaces;

said first top surfaces and said second top surfaces having a shape containable within a circle of a diameter of 25 mm; and at least one of respective minimum pitches between top edge perimeters of adjacent ones of said projections and top edge perimeters of adjacent ones of said protrusions being in a range of from 10 mm to 30 mm.

2. A cover for underground structures comprising:

a cover body having a body surface;

mutually independent projections arranged uniformly over the body surface of the cover body;

said projections having side surfaces and first top surfaces and protrusions formed on said first top surfaces of each of said projections, said protrusions having side surfaces and second top surfaces;

said second top surfaces having a shape containable within a circle of a diameter of 25 mm; and at least one of respective minimum pitches between top edge perimeters of adjacent ones of said projections and top edge perimeters of adjacent ones of said protrusions being in a range of from 10 mm to 30 mm.

3. The cover for underground structures according to claim 1 or 2 wherein:

at least some of the projections have sharp angle edges defined by said projections having said first top surfaces and said side surfaces thereof subtending an acute angle; and at least some of said protrusions have sharp angle edges defined by said protrusions having said second top surfaces and said side surfaces thereof subtending an acute angle.

4. The cover for underground structures according to claim 1 or 2 wherein at least some of said projections have sharp-angle edges defined by said projections having said first top surfaces and said side surfaces thereof subtending an acute angle.

5. The cover for underground structures according to claim 1 or 2 wherein at least some of said protrusions have sharp-angle edges defined by said protrusions having said second top surfaces and said side surfaces thereof subtending an acute angle.

6. The cover for underground structures according to claim 1 or 2 wherein at least one of said projections upon which said protrusions are formed has said first top surface at a height level above said body surface higher than that of other ones of said projections having said protrusions formed thereon.

7. The cover for underground structures according to claim 3 wherein at least one of said projections upon which said protrusions are formed has said first top surface at a height level above said body surface higher than that of other ones of said projections having said protrusions formed thereon.

8. The cover for underground structures according to claim 4 wherein at least one of said projections upon which said protrusions are formed has said first top surface at a height level above said body surface higher than that of other ones of said projections having said protrusions formed thereon.

9. The cover for underground structures according to claim 5 wherein at least one of said projections upon which said protrusions are formed has said first top surface at a height level above said body surface higher than that of other ones of said projections having said protrusions formed thereon.

10. A cover for underground structures comprising:

a cover body having a body surface;

mutually independent projections arranged uniformly over the body surface of the cover body;

said projections having top projection surfaces and protrusions formed on said projection top surfaces of at least some of said projections; and at least one of said projections upon which said protrusions are formed having said top projection surface thereof at a height level above said body surface higher than that of other ones of said projections having said protrusions formed thereon.

11. A cover for underground structures comprising:

a cover body having a body surface;

projections formed on the body surface of the cover body defining a protruding pattern;

said projections having side surfaces and top projection surfaces with protrusions formed on said top projection surfaces of at least some of said projections;

said protrusions having side surfaces and top protrusion surfaces;

at least some of the projections having sharp angle edges defined by said projections having said top projection surfaces and said side surfaces thereof subtending an acute angle; and at least some of said protrusions having sharp angle edges defined by said protrusions having said top protrusion surfaces and said side surfaces thereof subtending an acute angle.

12. A cover for underground structures comprising:

a cover body having a body surface;

projections formed on the body surface of the cover body defining a protruding pattern;

said projections having side surfaces and top projection surfaces with protrusions formed on said top projection surfaces of at least some of said projections; and at least some of said projections having sharp-angle edges defined by said projections having said top projection surfaces and said side surfaces thereof subtending an acute angle.

13. A cover for underground structures comprising:

a cover body having a body surface;

projections formed on the body surface of the cover body defining a protruding pattern;

said projections having top surfaces with protrusions formed on said top surfaces of at least some of said projections; and at least some of said protrusions having sharp-angle edges defined by said protrusions having top protrusion surfaces and side surfaces subtending an acute angle.

* * * * *